US007239095B2

(12) United States Patent
Ho et al.

(10) Patent No.: US 7,239,095 B2
(45) Date of Patent: Jul. 3, 2007

(54) DUAL-PLUNGER ENERGY SWITCH

(75) Inventors: Ching-Hung Ho, Antioch, CA (US); Daryl Oshatz, Oakland, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 16 days.

(21) Appl. No.: 11/200,984

(22) Filed: Aug. 9, 2005

(65) Prior Publication Data

US 2007/0035260 A1 Feb. 15, 2007

(51) Int. Cl.
*H05H 9/00* (2006.01)
*H01J 25/10* (2006.01)

(52) U.S. Cl. ..... 315/505; 315/5.41

(58) Field of Classification Search ..... 315/5.41, 315/500, 501, 505, 506, 507
See application file for complete search history.

(56) References Cited

U.S. PATENT DOCUMENTS 4,286,192 A 8/1981 Tanabe et al. ..... 315/5.41
4,382,208 A 5/1983 Meddaugh et al. ..... 315/5.41
4,629,938 A * 12/1986 Whitham ..... 315/5.41
4,746,839 A * 5/1988 Kazusa et al. ..... 315/5.41
5,777,534 A * 7/1998 Harrison ..... 333/202
6,366,021 B1 * 4/2002 Meddaugh et al. ..... 315/5.41
6,407,505 B1 * 6/2002 Bertsche ..... 315/5.41
2005/0212465 A1 * 9/2005 Zavadtsev et al. ..... 315/500

* cited by examiner

*Primary Examiner*—Shih-Chao Chen
*Assistant Examiner*—Minh Dieu A

(57) ABSTRACT

A dual-plunger energy switch assembly for standing wave linear particle beam accelerators capable of operating in a higher energy mode and a lower energy mode employs two mechanical plungers that can be extended different distances inside two side cavities of the linear accelerator. When the linear accelerator is operated in the higher energy mode, both plungers are retracted out of the side cavities. To achieve high output while the linear accelerator is operated in the lower energy mode, the two plungers are radially inserted into the two side cavities to adjust the electromagnetic accelerating field along the length of the accelerator, e.g., one plunger is inserted into a side cavity so that the plunger touches the smile surface of the side cavity, while the second plunger is inserted into a second side cavity so that the plunger is adjacent to, but not touching, the smile surface of the side cavity.

20 Claims, 14 Drawing Sheets

DUAL-PLUNGER ENERGY SWITCH

BACKGROUND OF THE INVENTION

The present invention relates generally to the field of standing wave linear particle beam accelerators, and more particularly to an energy switch assembly for a standing wave linear particle beam accelerator having two mechanical plungers, which, when radially inserted into two side cells or cavities of the linear particle beam accelerator, increases the output of the linear accelerator at lower energies.

Medical linear particle beam accelerators that operate at two or more energies suffer from the fundamental limitation that the internal structure cannot be optimized for multiple energies. Because the length of the accelerating structure is fixed, in order to produce both high energy and low energy beams, the cavities are operated at maximum electric field gradient in the higher energy mode and lower gradient in the lower energy mode. The lower gradient causes more electrons to be lost as they travel through the structure, resulting in loss of output in the low energy mode.

To reduce this loss in output, linear particle beam accelerators were developed which employ energy switches. Energy switches typically employ one or more plungers which can be inserted into side cavities of the linear accelerator. Such energy switches concentrate the radio frequency (RF) power in the upstream section of the accelerator structure, before the switch location. In this manner, energy switches cause the gradient to be higher in the upstream portion of the accelerator structure so that electrons are accelerated and captured more efficiently, resulting in higher output in the lower energy mode.

Energy switches may employ radial or transverse plunger arrangements. In energy switches employing a radial plunger arrangement, the plunger is inserted into the side cavity along an axis which lies in a plane normal to the electron beam, while in energy switches employing a transverse plunger arrangement, the plunger is inserted into the side cavity along an axis which lies in a plane parallel to the electron beam. Known to the art are energy switches that employ multiple plungers which are positioned within a single side cavity of the linear accelerator. Such energy switches are used to provide the linear accelerator with three or more output levels.

Prior energy switches achieve high dose rates at low energy, but, because of heating, require direct water-cooling of the plunger during operation. Thus, the energy switches are vulnerable to water leaks and require multiple control system interlocks. Additionally, the side cavity in which the plungers are positioned must have a modified, more complex structure than the other side cavities of the accelerator.

Consequently, it would be desirable to provide an energy switch assembly for standing wave linear particle beam accelerators that increases the output of the accelerator at lower energies, but which does not cause excessive heating, and thus, does not require water-cooling. Additionally, it would be desirable to provide an energy switch assembly that does not require the use of side cavities having a special internal geometry.

SUMMARY OF THE INVENTION

Accordingly, the present invention is directed to a dual-plunger energy switch assembly for standing wave linear particle beam accelerators capable of operating in a higher energy mode and a lower energy mode. The dual-plunger energy switch assembly employs two mechanical plungers that can be extended different distances inside two side cells or cavities of the linear accelerator downstream of the RF input. When the linear accelerator is operated in the higher energy mode, both plungers are retracted out of the side cavities. To achieve high output while the linear accelerator is operated in the lower energy mode, the two plungers are radially inserted into the two side cavities to adjust the electromagnetic accelerating field along the length of the accelerator. For example, in a specific embodiment, one plunger is radially inserted into a side cavity so that the plunger touches the internal surface of the side cavity opposite the plunger assembly. The second plunger is radially inserted into a second side cavity so that the plunger is adjacent to, but not touching, the internal surface of the side cavity opposite the plunger assembly. In this manner, the dual-plunger energy switch assembly increases the output of the linear accelerator at lower energies without generating excessive heating, eliminating the need for water-cooling of the energy switch assembly. The energy switch assembly also does not require the use of side cavities having a special internal geometry. In specific embodiments, the dual-plunger energy switch assembly includes a common actuator assembly mechanically coupled to the plunger assemblies for positioning the plungers within the side cavities.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF SPECIFIC EMBODIMENTS

Figure 1:
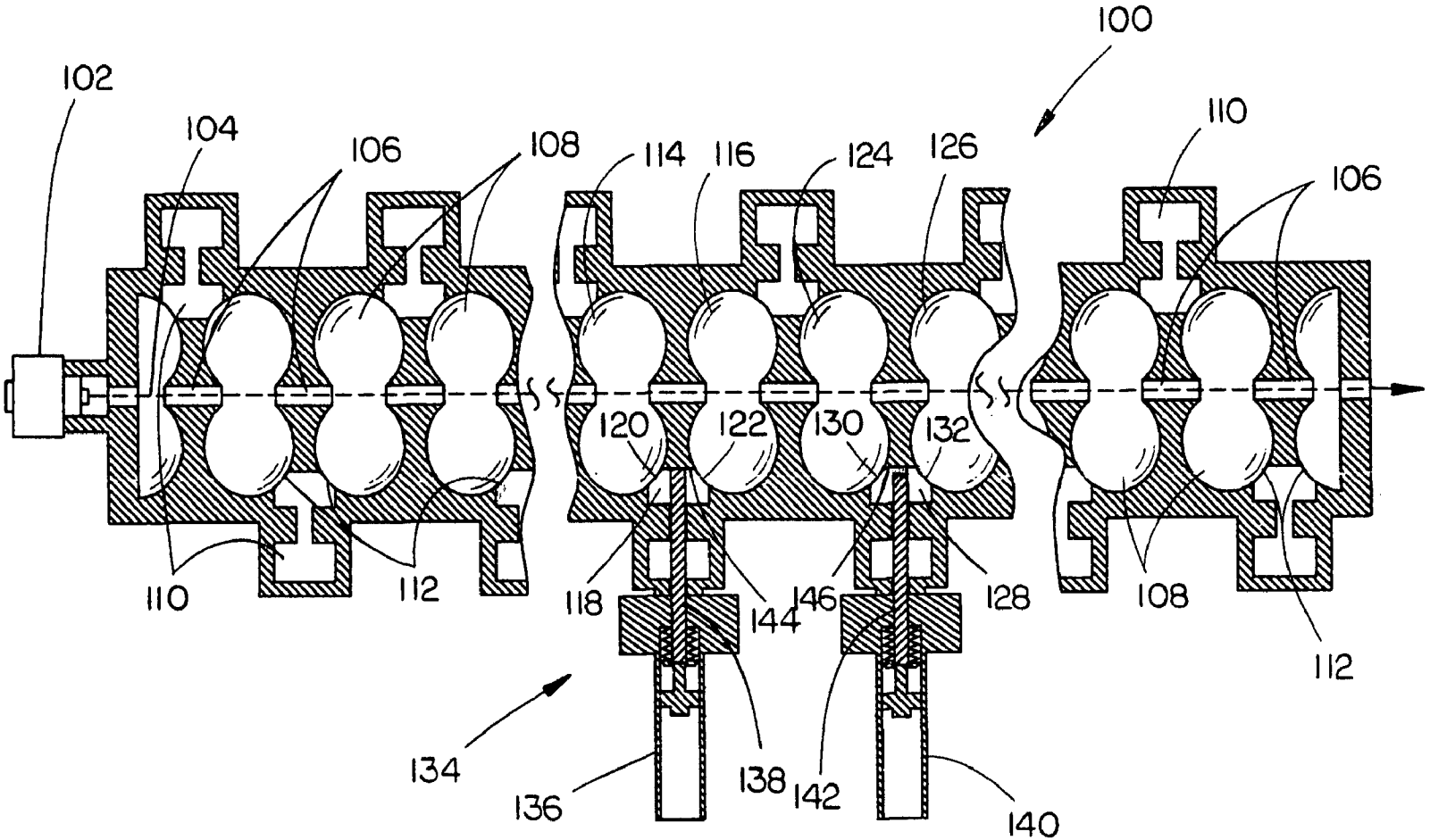
FIG. 1 is a partial cross-sectional top plan view illustrating a standing wave linear particle beam accelerator including an energy switch assembly in accordance with an exemplary embodiment of the present invention, wherein a first plunger is fully extended into the first side cavity and a second plunger is partially extended a predetermined distance into the second side cavity.
Figure 2:
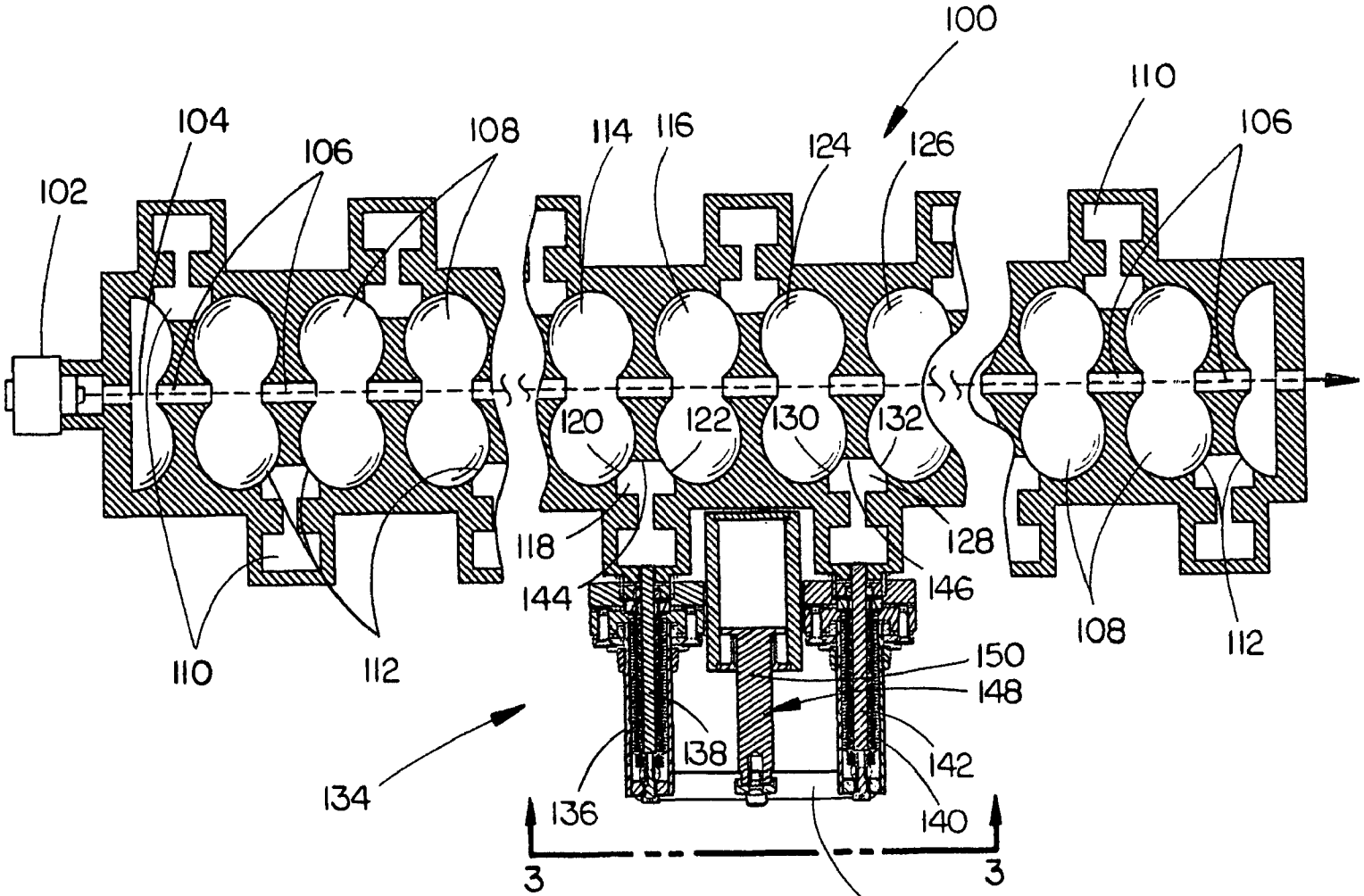
FIG. 2 is a partial cross-sectional top plan view illustrating a standing wave linear particle beam accelerator including an energy switch assembly in accordance with a specific embodiment of the present invention, wherein a first plunger and a second plunger are in a first position where the first plunger is retracted from a first side cavity and the second plunger is retracted from a second side cavity.
Figure 3:
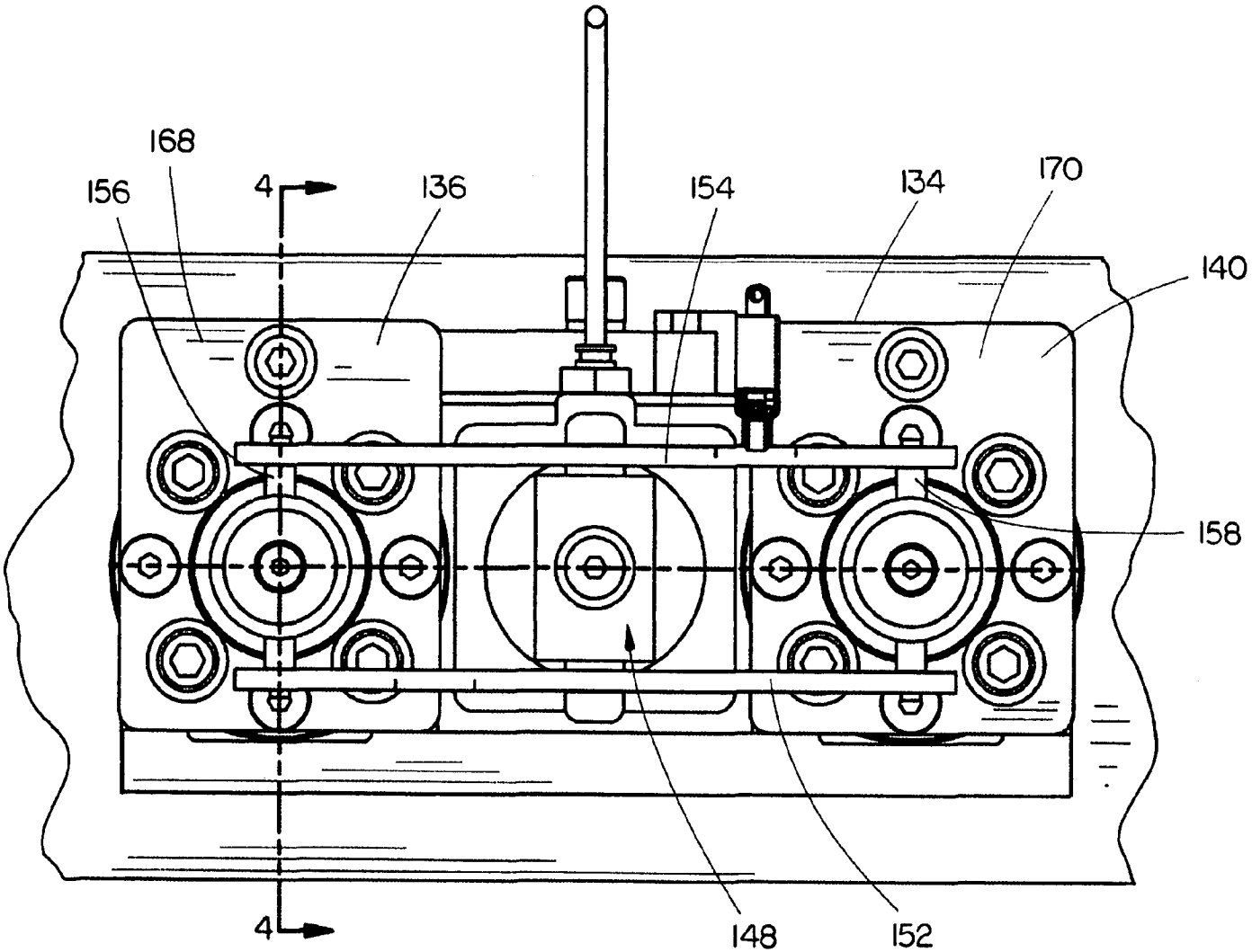
FIG. 3 is a partial front elevation view of the standing wave linear particle beam accelerator and the energy switch assembly illustrated in FIG. 2.
Figure 4:
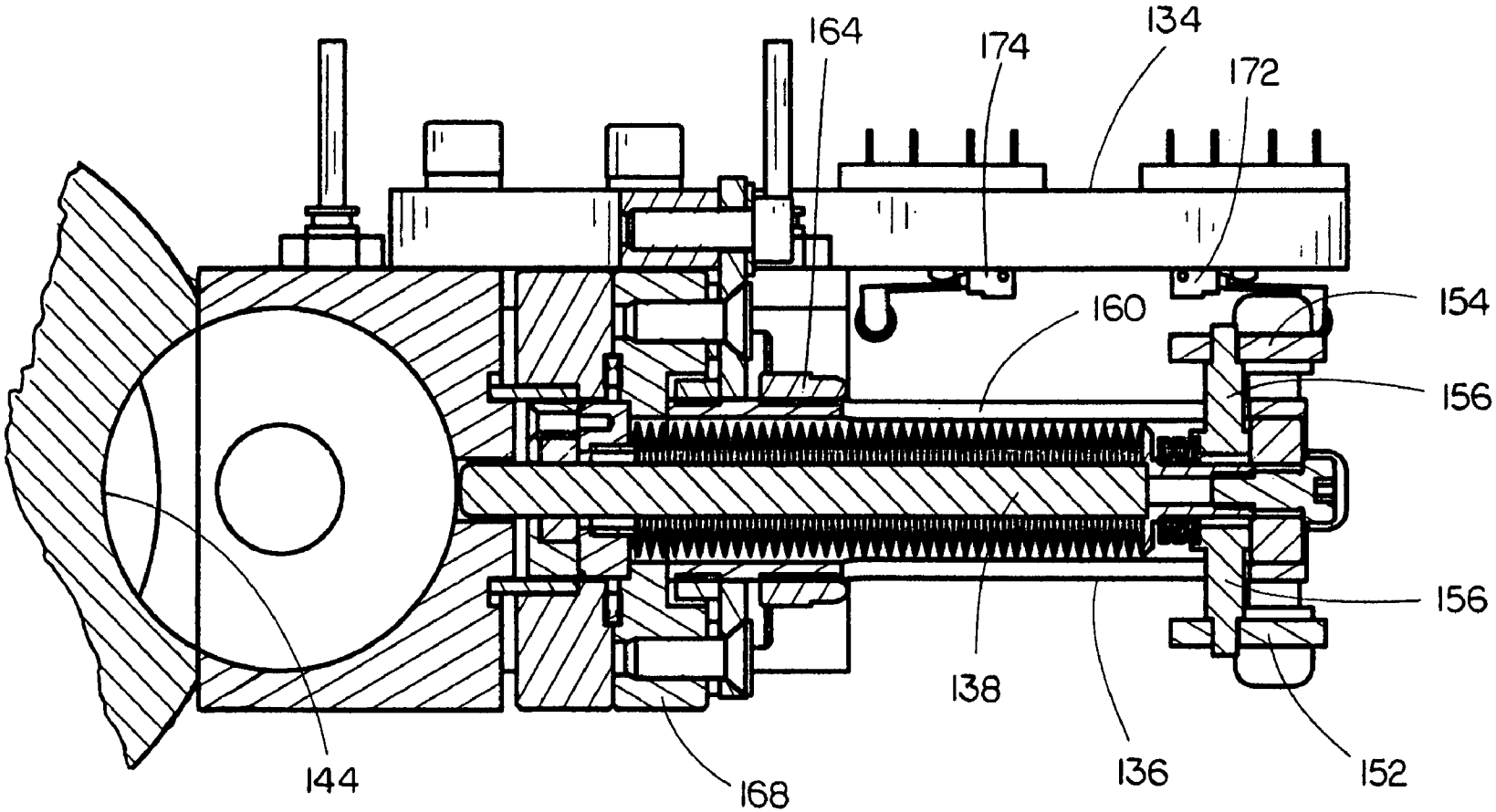
FIG. 4 is a cross-sectional side elevation view of the standing wave linear particle beam accelerator and the energy switch assembly illustrated in FIG. 2.
Figure 5:
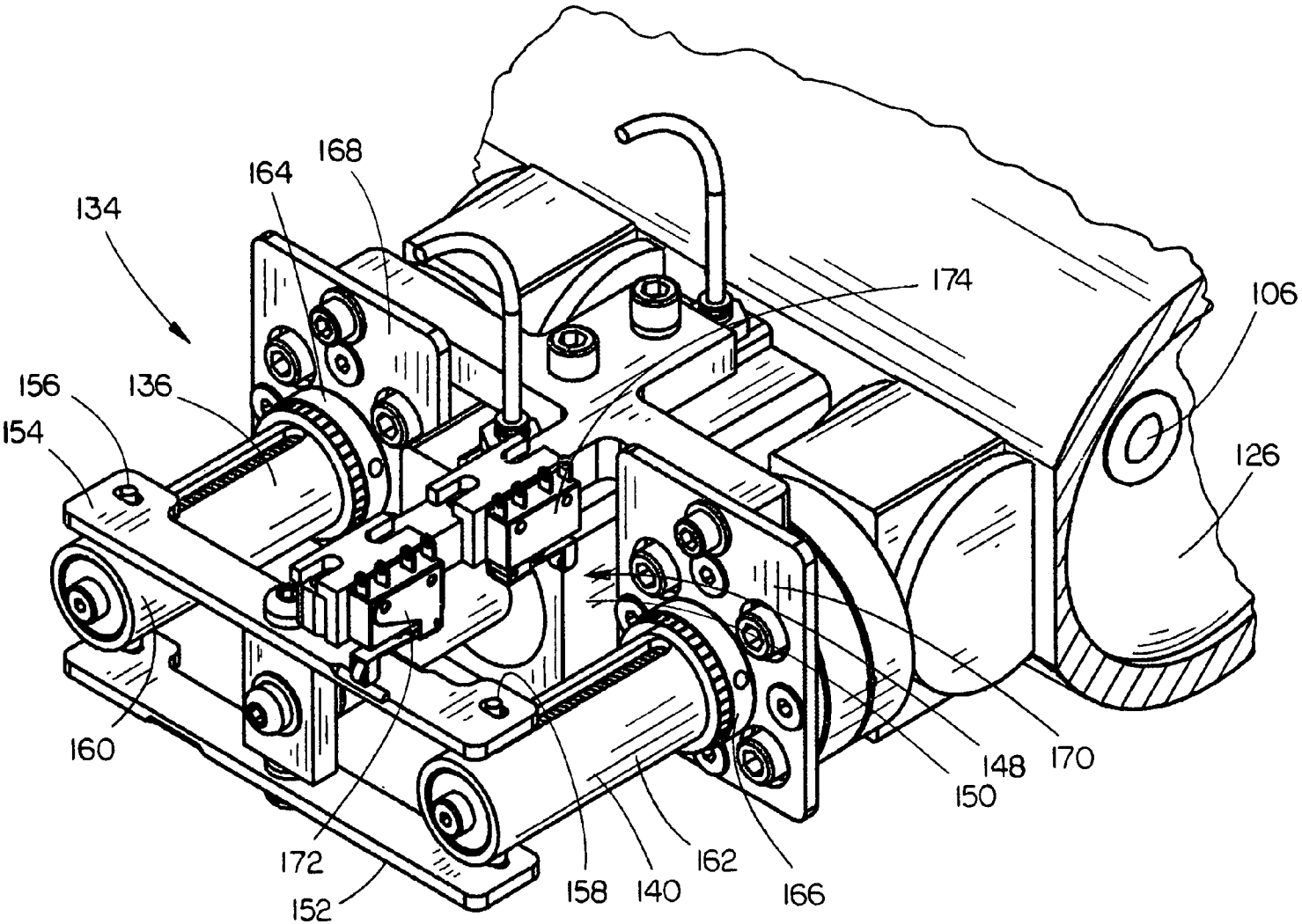
FIG. 5 is a partial isometric view of the standing wave linear particle beam accelerator and the energy switch assembly illustrated in FIG. 2, showing the plungers in retracted positions.
Figure 6:
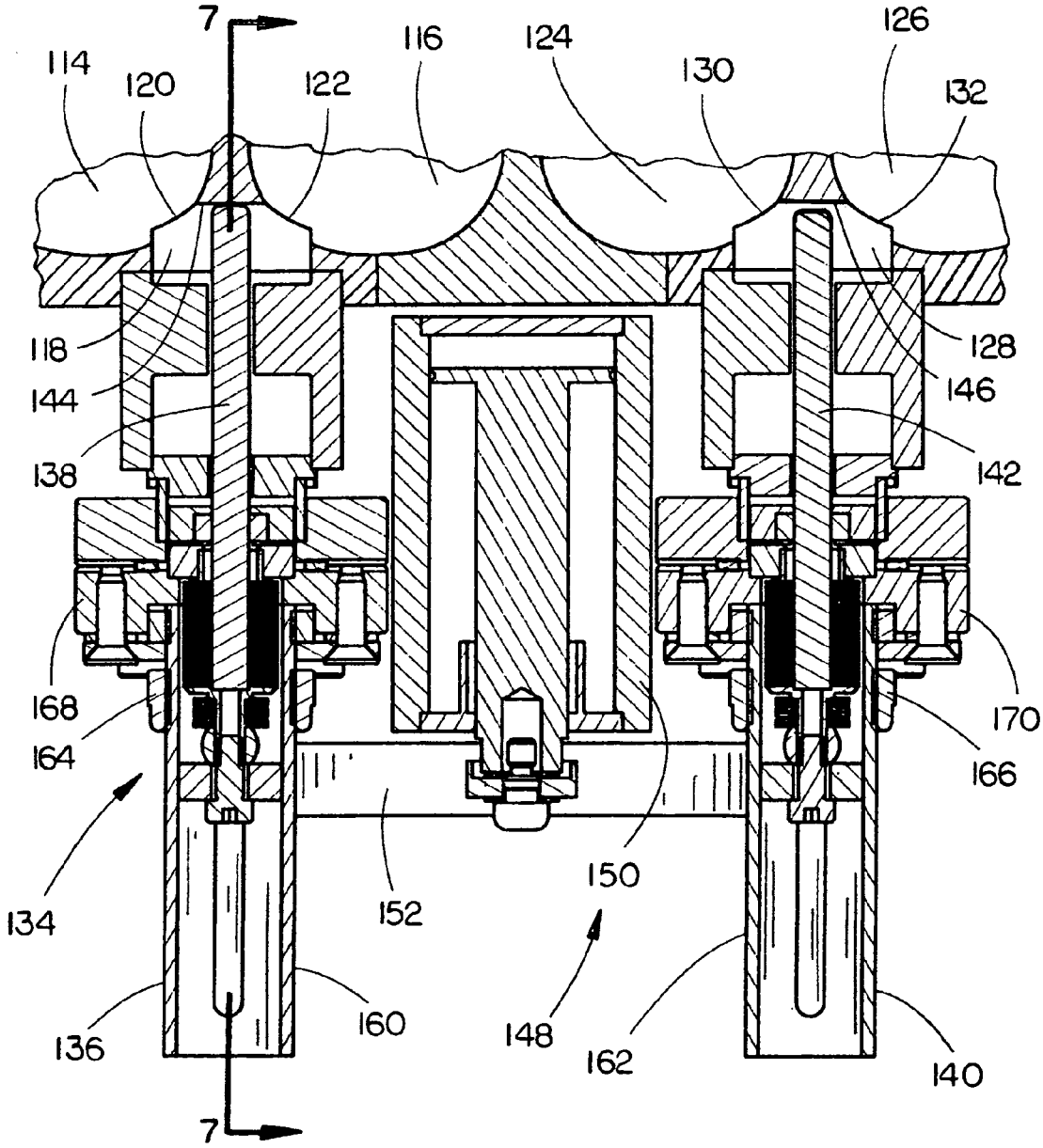
FIG. 6 is a partial cross-sectional top plan view of the standing wave linear particle beam accelerator and the energy switch assembly illustrated in FIG. 2, wherein the first plunger and the second plunger are in a second position where the first plunger is fully extended into the first side cavity and the second plunger is partially extended a predetermined distance into the second side cavity.
Figure 7:
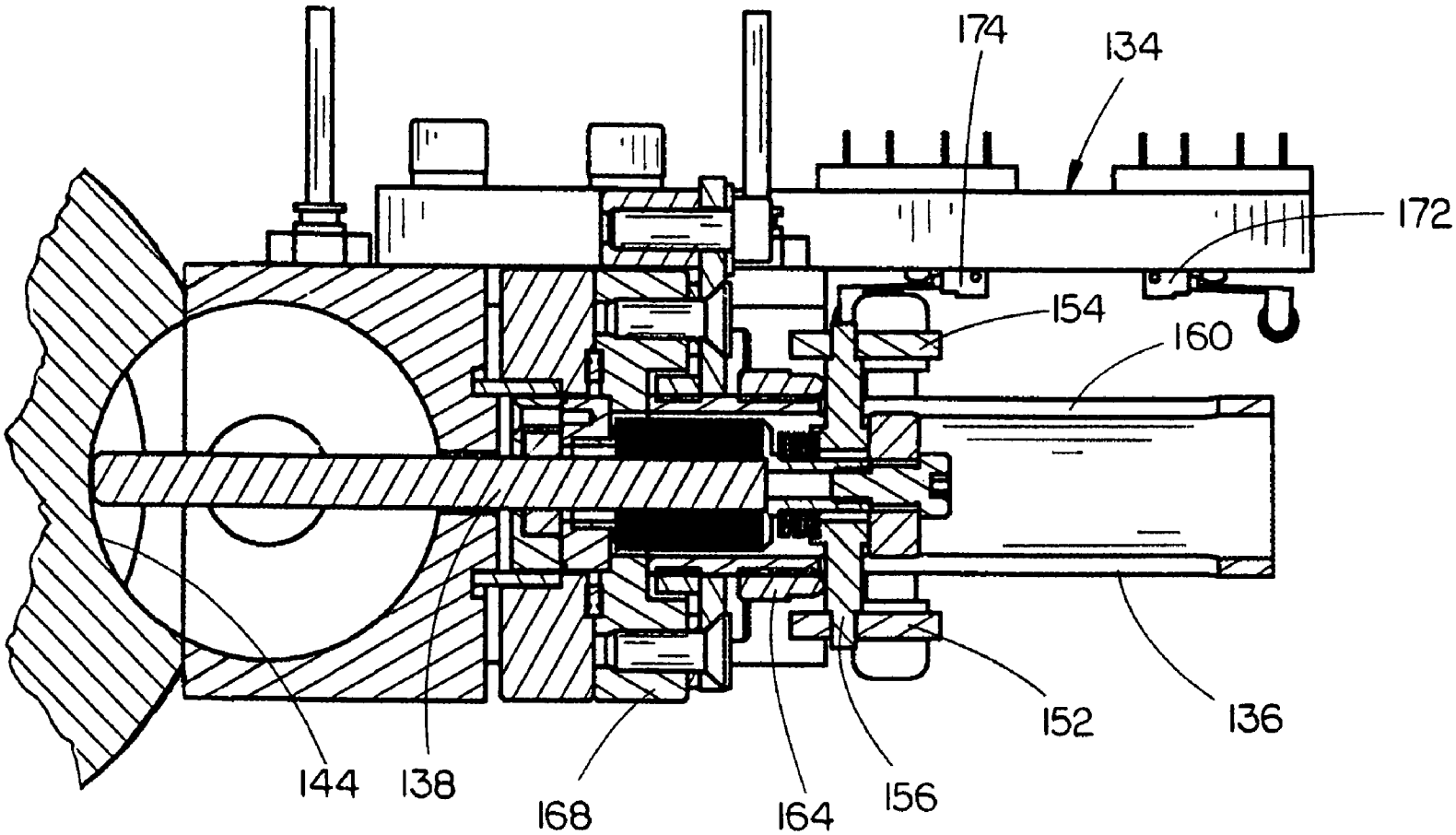
FIG. 7 is a cross-sectional side elevation view of the standing wave linear particle beam accelerator and the energy switch assembly illustrated in FIG. 6.
Figure 8:
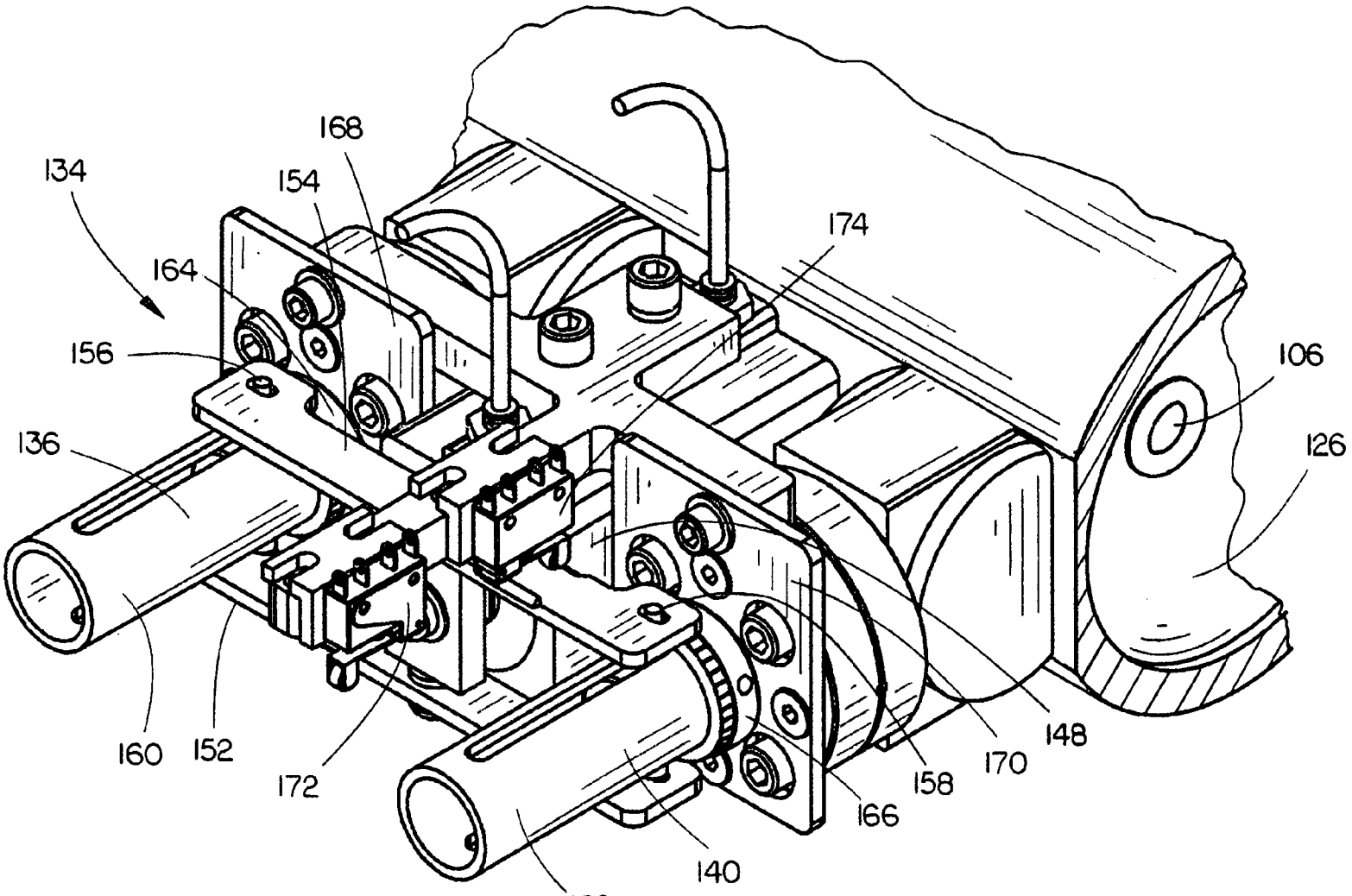
FIG. 8 is a partial isometric view of the standing wave linear particle beam accelerator and the energy switch assembly illustrated in FIG. 6, showing the plungers in inserted positions.

Reference will now be made in detail to the presently preferred embodiments of the invention, examples of which are illustrated in the accompanying drawings.

Referring generally to FIGS. 1 through 14, a standing wave linear particle beam accelerator 100 is described in accordance with exemplary embodiments of the present invention. The standing wave linear accelerator 100 includes a particle beam source for emitting a stream of charged particles, such as an electron beam source 102 for emitting an electron beam 104, or the like. The electron beam 104 is directed longitudinally through the linear accelerator 100, traversing a passage 106 defined through a series of electromagnetically coupled accelerating cavities 108. The accelerating cavities 108 have approximately the same resonant frequency and are electromagnetically coupled with side cavities 110 through irises 112. In embodiments, adjacent accelerating cavities 108 are electromagnetically coupled with a common side cavity 110. For example, a first accelerating cavity 114 and an adjacent second accelerating cavity 116 are coupled with a first side cavity 118 through irises 120 and 122. Similarly, a third accelerating cavity 124 and an adjacent fourth accelerating cavity 126 are coupled with a second side cavity 128 through irises 130 and 132.

The standing wave linear particle beam accelerator 100 includes a mechanical dual-plunger energy switch assembly 134 for detuning the frequency or changing the electromagnetic field distribution in selected side cavities 110 and supplying at least two levels of output energy from the linear accelerator 100. Detuning the frequency in a selected side cavity 110 causes that side cavity to be out of resonance with the other side cavities 110, and changing the electromagnetic field distribution in a selected side cavity 110 changes the coupling factor between adjacent accelerating cavities 108 electromagnetically coupled with that side cavity. Either detuning the frequency or changing the electromagnetic field distribution in a selected side cavity 110 changes the amplitude of the electric field profile in accelerating cavities 108 following that side cavity. Thus, coupling of the microwave energy through the selected side cavity 110 is controlled by the position of the mechanical energy switch assembly 134 for varying the output of the linear accelerator 100.

In the embodiments illustrated in FIGS. 1 through 8, the energy switch assembly 134 includes a first plunger assembly 136 having a first plunger 138 positionable within the first side cavity 118 and a second plunger assembly 140 having a second plunger 142 positionable within the second side cavity 128. When radially inserted into the side cavities 110, the first plunger 138 detunes the first side cavity 118, while the second plunger 142 detunes the second side cavity 128. Thus, the energy switch assembly 134 is capable of changing the electric field profile in the second accelerating cavity 116 from that in the first accelerating cavity 114, and changing the electric field profile in the fourth accelerating cavity 126 from that in the third accelerating cavity 124. By changing the electric field profile in the accelerating cavities 108 via the energy switch assembly 134, both high energy and low energy particle beams may be generated by the linear accelerator 100 of the present invention.

Figure 9:
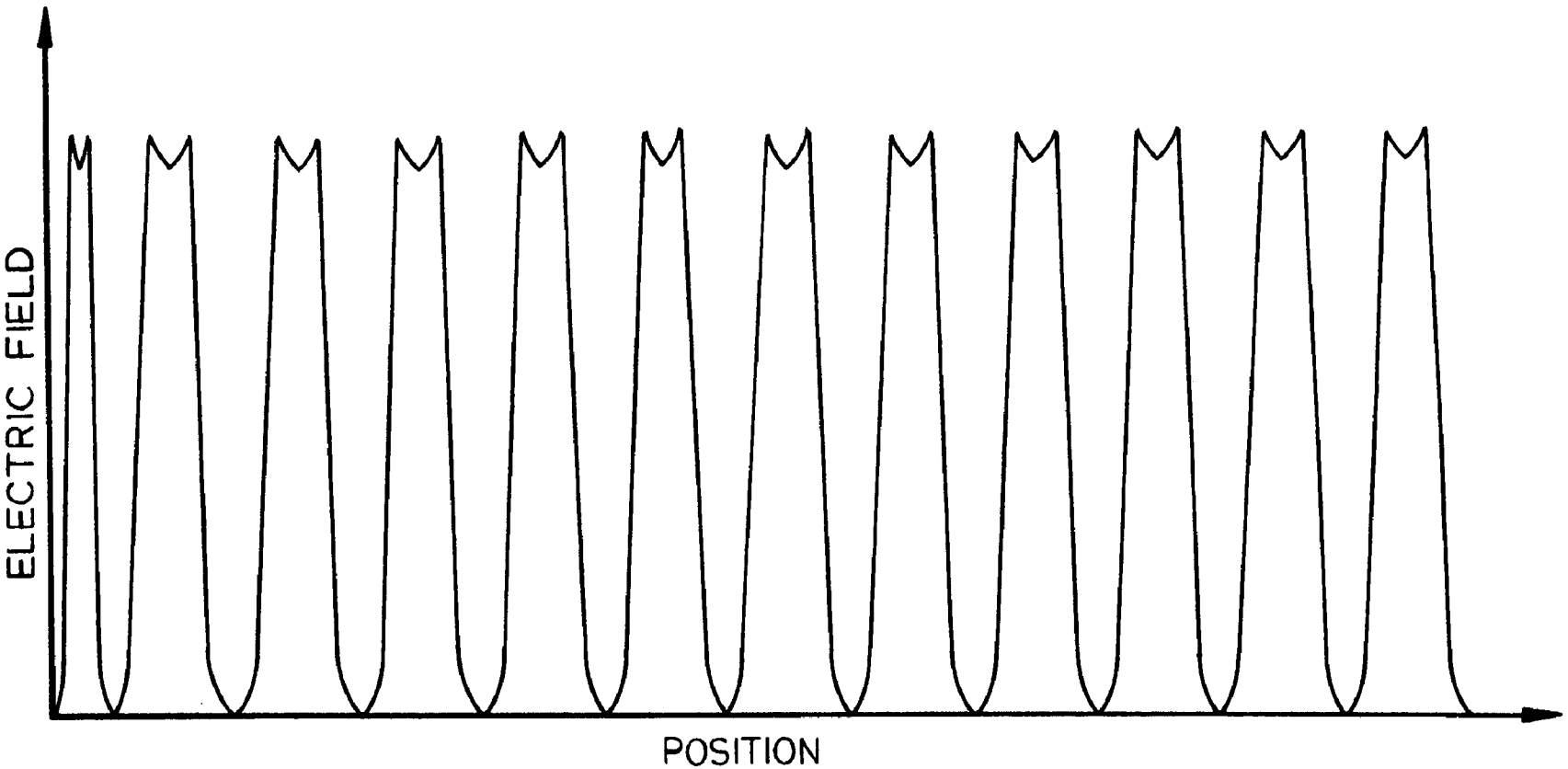
FIG. 9 is a graph illustrating an electric field profile as measured along the axis of an exemplary standing wave linear particle beam accelerator including an energy switch assembly in accordance with the present invention, wherein a first plunger and a second plunger are in a first position where the first plunger is retracted from a first side cavity and the second plunger is retracted from a second side cavity.
Figure 10:
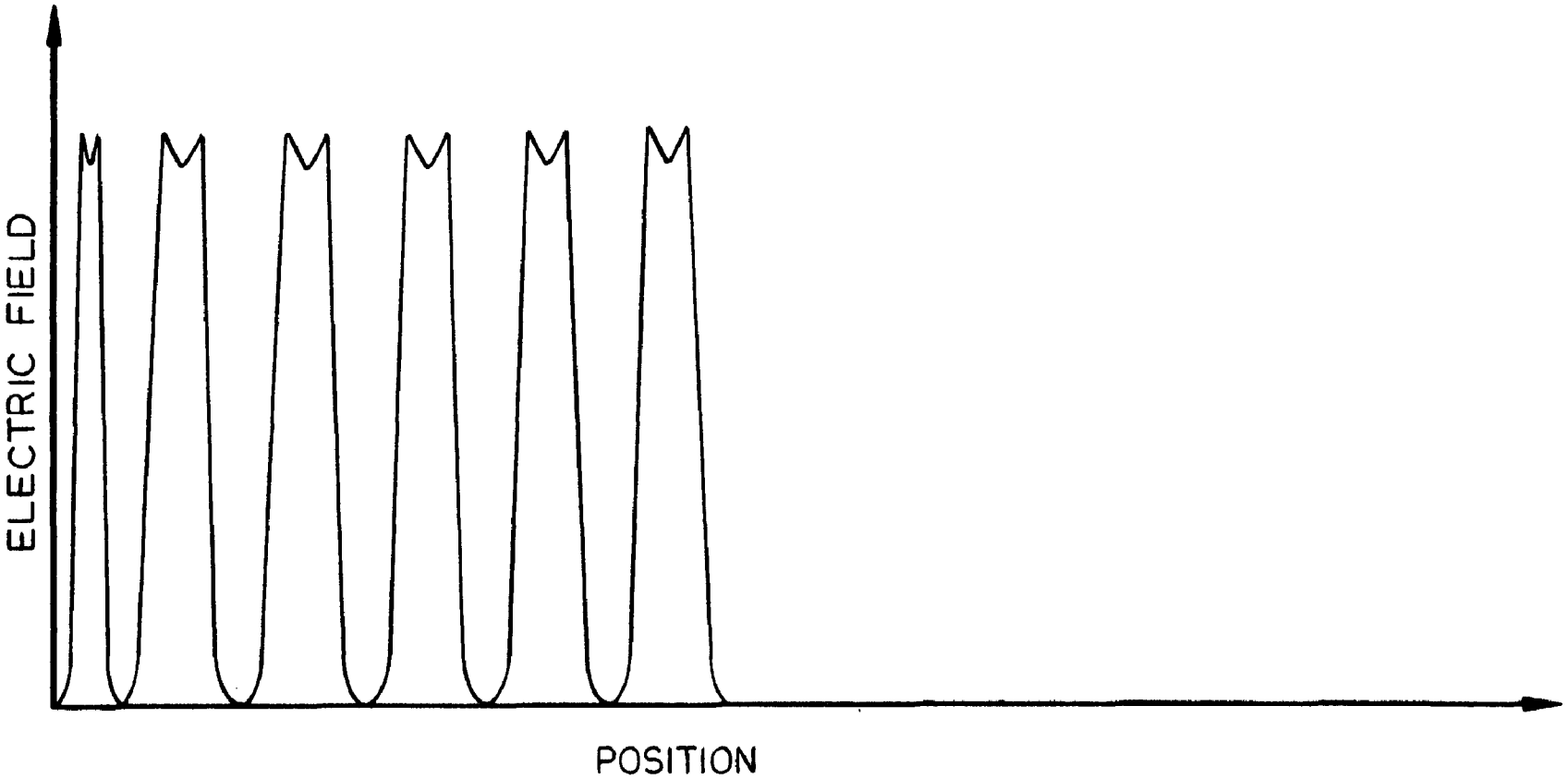
FIG. 10 is a graph illustrating an electric field profile as measured along the axis of an exemplary standing wave linear particle beam accelerator, wherein a first plunger is fully extended into a first side cavity.

FIG. 9 is illustrative of an exemplary electric field profile along the series of electromagnetically coupled accelerating cavities 108 when the energy switch assembly 134 is in a first position, i.e., where the first plunger 138 is retracted from the first side cavity 118 and the second plunger 142 is retracted from the second side cavity 128. It may be seen that the electric field strength is at least approximately constant from one end of the linear accelerator 100 to the other in this configuration, for generating a high energy particle beam. FIG. 10 illustrates an electric field profile along the series of electromagnetically coupled accelerating cavities 108 when the first plunger 138 is fully inserted into the first side cavity 118 so that it touches an internal surface of the first side cavity 118 opposite the first plunger assembly 136, referred to as the internal smile surface 144. It may be seen that the electric field amplitude decreases to a value near zero in the accelerating cavities 108 following the first side cavity 118, illustrating the detuning effect of fully inserting the first plunger 138 into the first side cavity 118 so that it touches the smile surface 144.

Figure 11:
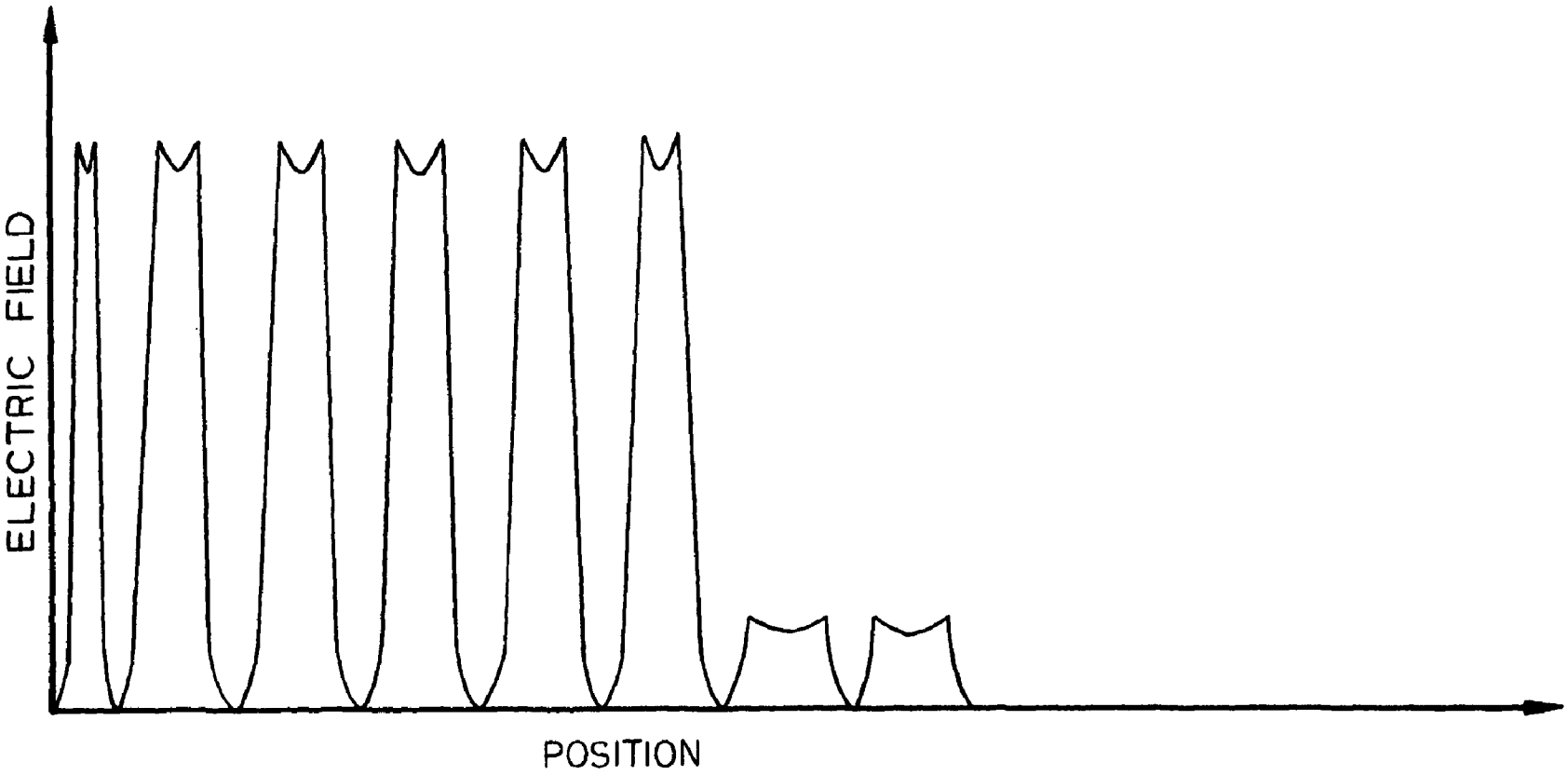
FIG. 11 is a graph illustrating an electric field profile as measured along the axis of an exemplary standing wave linear particle beam accelerator including an energy switch assembly in accordance with the present invention, wherein a first plunger and a second plunger are in a second position where the first plunger is fully extended into a first side cavity and the second plunger is partially extended a predetermined distance into a second side cavity.

FIG. 11 is illustrative of an exemplary electric field profile along the series of electromagnetically coupled accelerating cavities 108 when the energy switch assembly 134 is in a second position, i.e., where the first plunger 138 is radially inserted into the first side cavity 118 a first predetermined distance and the second plunger 142 is radially inserted into the second side cavity 128 a second predetermined distance. Preferably, the first plunger 138 is inserted into the first side cavity 118 the first predetermined distance for detuning the first side cavity 118 and decreasing the electric field amplitude in accelerating cavities following the first side cavity 118. For instance, in one specific embodiment, the first plunger 138 is fully inserted into the first side cavity 118 so that it touches the internal smile surface 144 of the first side cavity 118. In exemplary embodiments, insertion of the first plunger 138 to the smile surface 144 of the first side cavity 118 provides the maximum detune of the first side cavity's resonant frequency, for achieving a wide mode separation due to degeneracy of modes for the linear accelerator 100. Those of skill in the art will appreciate that the wide mode separation of the operating frequency from adjacent modes may improve beam performance.

In embodiments of the invention, the first plunger 138 and the first side cavity 118 are closer to the electron beam source 102 than the second plunger 142 and the second side cavity 128. That is, the first plunger 138 and the first side cavity 118 are "upstream" of the second plunger 142 and the second side cavity 128, while the second plunger 142 and the second side cavity 128 are "downstream" of the first plunger 138 and the first side cavity 118. Preferably, the second plunger 142 is inserted into the second side cavity 128 the second predetermined distance for detuning the second side cavity 128 and increasing the electric field amplitude in accelerating cavities between the first plunger assembly 136 and the second plunger assembly 140. For example, in one specific embodiment, the second plunger 142 is inserted into the second side cavity 128 so that the second plunger 142 is adjacent to, but not touching, the internal smile surface 146 of the second side cavity 128. In exemplary embodiments, insertion of the second plunger 142 to a position slightly away from the smile surface 146 of the second side cavity 128 slightly raises the field amplitude in the accelerating cavities 108 between the first plunger 138 and the second plunger 142, providing an appropriately slight increase in the microwave field between the first and second plungers 138 and 142 and acting as a fine tuning mechanism. With both the first plunger 138 fully inserted into the first side cavity 118 and the second plunger 142 partially inserted into the second side cavity 128, the advantage of wide mode separation due to degeneracy of accelerator modes remains valid.

For example, in the embodiments illustrated in FIGS. 1 through 8, insertion of the second plunger 142 adjacent to, but not touching, the smile surface 146 of the second side cavity 128 slightly raises the field amplitude in the second accelerating cavity 116 and the third accelerating cavity 124 between the first and second plungers 138 and 142. It should be noted that the embodiment illustrated in FIG. 1, showing the energy switch assembly 134 in the second position, depicts the second plunger 142 an exaggerated distance away from the smile surface 146 of the second side cavity 128. For instance, in one exemplary embodiment, the second plunger 142 is between one and two millimeters (mm) away from the smile surface 146 of the second side cavity 128. It may be seen that the electric field amplitude decreases to a value near zero in the accelerating cavities 108 downstream of the second side cavity 128, illustrating the detuning effect of fully extending the first plunger 138 into the first side cavity 118 and partially extending the second plunger 142 a predetermined distance into the second side cavity 128 for generating a low energy particle beam.

In embodiments of the invention, the energy switch assembly 134 includes an actuator assembly 148 mechanically coupled to the first plunger assembly 136 and the second plunger assembly 140, for positioning the first plunger 138 within the first side cavity 118 and the second plunger 142 within the second side cavity 128. In one specific embodiment, the actuator assembly 148 includes an actuator 150 positioned between the first plunger assembly 136 and the second plunger assembly 140. A first cross bar 152 and a second cross bar 154 are pivotally connected to the actuator 150, the first plunger assembly 136, and the second plunger assembly 140 for moving the first plunger 138 and the second plunger 142 between a first position where the first plunger 138 is retracted from the first side cavity 118 and the second plunger 142 is retracted from the second side cavity 128, and a second position where the first plunger 138 is fully extended into the first side cavity 118 and the second plunger 142 is partially extended a predetermined distance into the second side cavity 128. For example, a first thrust bar 156 coupled to the first plunger 138 and a second thrust bar 158 coupled to the second plunger 142 are engaged by the first cross bar 152 and the second cross bar 154. The first thrust bar 156 and the second thrust bar 158 are movable between the first and second positions via the actuator 150.

The actuator assembly 148 provides synchronous actuation of the first plunger 138 and the second plunger 142. For instance, in the embodiment illustrated, the actuator 150 comprises a pneumatic actuator capable of moving the first plunger 138 and the second plunger 142 between the first and second positions synchronously. In other embodiments, the actuator assembly 148 may include an electric actuator, a hydraulic actuator, or another type of actuator as contemplated by one of skill in the art. Preferably, the first cross bar 152 and the second cross bar 154 include slots for engaging the first thrust bar 156 and the second thrust bar 158 and preventing rotational torque on the first plunger assembly 136 and the second plunger assembly 140. For example, in one embodiment, the ends of the first thrust bar 156 and the second thrust bar 158 are cylindrical for traveling in slots formed in the first cross bar 152 and the second cross bar 154. In this manner, rotational torque on the first plunger assembly 136 and the second plunger assembly 140 may be prevented.

In one embodiment, the first plunger 138 and the second plunger 142 extend from a first tube 160 and a second tube 162 into the first side cavity 118 and the second side cavity 128. For instance, the first plunger 138 and the second plunger 142 are coupled with bushings for guiding the plungers through the first tube 160 and the second tube 162, while the first thrust bar 156 and the second thrust bar 158 travel through slots included in the first tube 160 and the second tube 162 for moving the first plunger 138 and the second plunger 142 between the first and second positions. Moreover, the first tube 160 and the second tube 162 may protect internal components of the first plunger assembly 136 and the second plunger assembly 140, including welded bellows, or the like, as well as limiting the travel of the first and second plungers. For further limiting the travel of the first plunger 138 and the second plunger 142, a first micrometer nut 164 and a second micrometer nut 166 may be included with the first plunger assembly 136 and the second plunger assembly 140. For instance, the first micrometer nut 164 and the second micrometer nut 166 may be theadably attached to the first tube 160 and the second tube 162, respectively, acting as hard stops for the first thrust bar 156 and the second thrust bar 158 for limiting the travel of the first plunger 138 and the second plunger 142.

Preferably, the energy switch assembly 134 includes a first flange 168 for securing the first plunger assembly 136 to the first side cavity 118 and a second flange 170 for securing the second plunger assembly 140 to the second side cavity 128. Moreover, a clamp plate may be included for connecting the actuator assembly 148 to the linear accelerator 100. Thus, the first flange 168, the second flange 170, and the clamp plate secure the energy switch assembly 134 to the linear accelerator 100. In exemplary embodiments, the first flange 168 and the second flange 170 are configured for allowing removal of non-vacuum components prior to bakeout. For example, in one specific embodiment, the first plunger assembly 136 and the second plunger assembly 140 include bolted conflat vacuum flanges for providing seals compatible with bakeout.

In exemplary embodiments of the present invention, microswitches 172 and 174 are included for indicating the positions of the first plunger 138 and the second plunger 142. For instance, microswitch 172 may be actuated when the energy switch assembly 134 is in the first position, while microswitch 174 may be activated when the energy switch assembly 134 is in the second position. It is contemplated that other techniques may be utilized for determining the position of the energy switch assembly 134 as contemplated by one of skill in the art. Further, microswitches 172 and 174 may be used for limiting the travel of the energy switch assembly 134. For example, the energy switch assembly 134 may be moved in a first direction until microswitch 172 is actuated, indicating that the first plunger assembly 136 and the second plunger assembly 140 are in the first position, while the energy switch assembly 134 may be moved in a second direction until microswitch 174 is actuated, indicating that the first plunger assembly 136 and the second plunger assembly 140 are in the second position.

Preferably, spring washers such as Belleville washers, or the like, are included with the energy switch assembly 134 for allowing the first plunger 138 to contact the smile surface 144 without causing excessive wear of the smile surface 144. It is contemplated that other techniques may be utilized for preventing undue force from the first plunger 138 to the smile surface 144 as well, without departing from the scope and intent of the present invention.

In exemplary embodiments of the present invention, the energy switch assembly 134 is primarily air cooled, i.e. the energy switch assembly 134, including the first plunger assembly 136 and the second plunger assembly 140, is passively cooled by its surroundings and requires no specific water cooling. In one embodiment, the energy switch assembly 134 is primarily cooled by ambient air found in the environment the linear accelerator 100 is operated in, while in another embodiment, air is forced over the energy switch assembly 134 for cooling, such as by utilizing a fan or the like. Those of skill in the art will appreciate that some conductive cooling of the energy switch assembly 134 to the outside structure of the linear accelerator 100 may occur as well, without departing from the scope and intent of the present invention. For instance, in specific embodiments, some conductive cooling of the energy switch assembly 134 to a built-in water cooling system thermally coupled with the outside structure of the linear accelerator 100 may occur.

Figure 12:
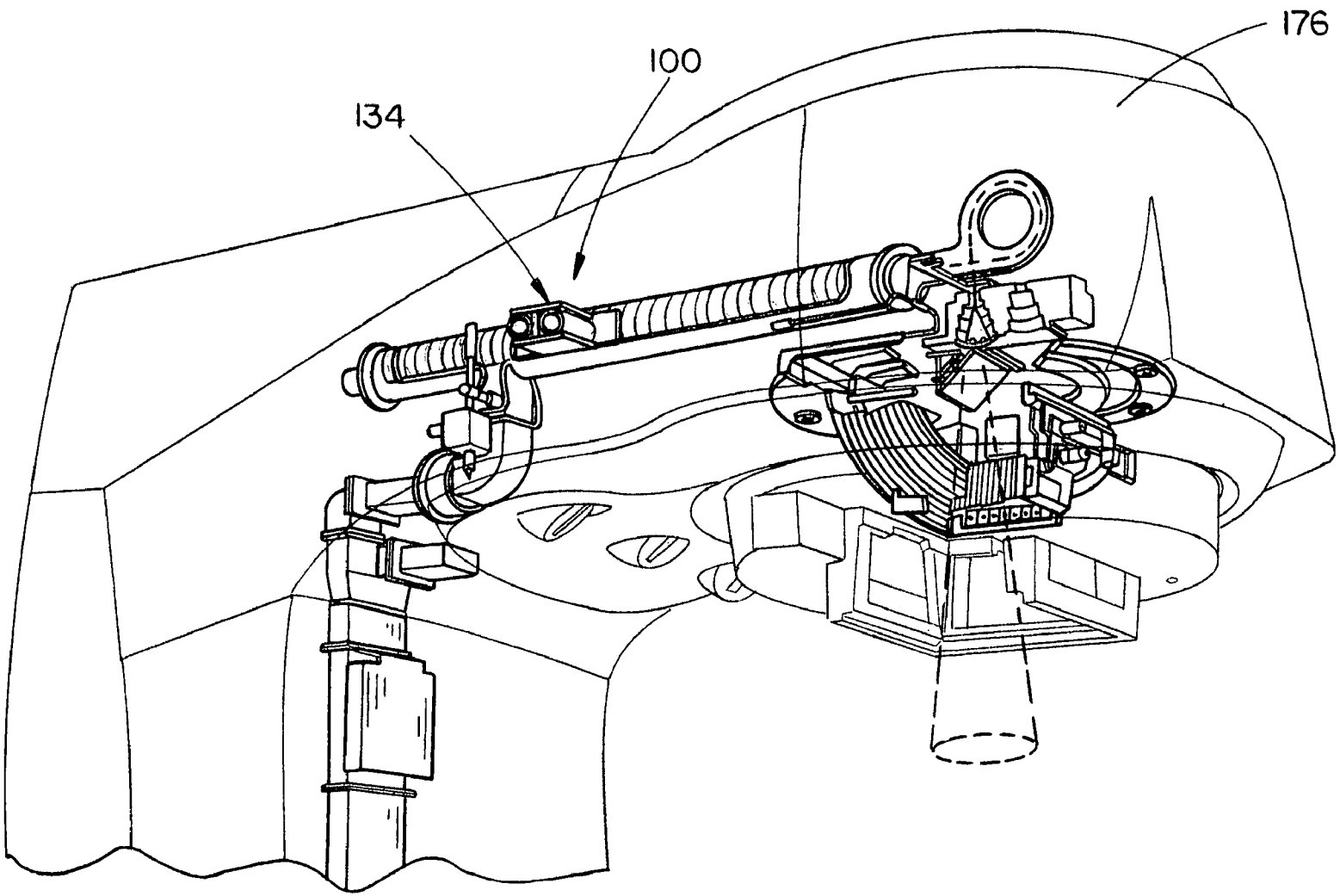
FIG. 12 is an isometric view of a standing wave linear particle beam accelerator including an energy switch assembly in accordance with an exemplary embodiment of the present invention, wherein the standing wave linear particle beam accelerator and the energy switch assembly are included with a device for external beam radiation treatment.
Figure 13:
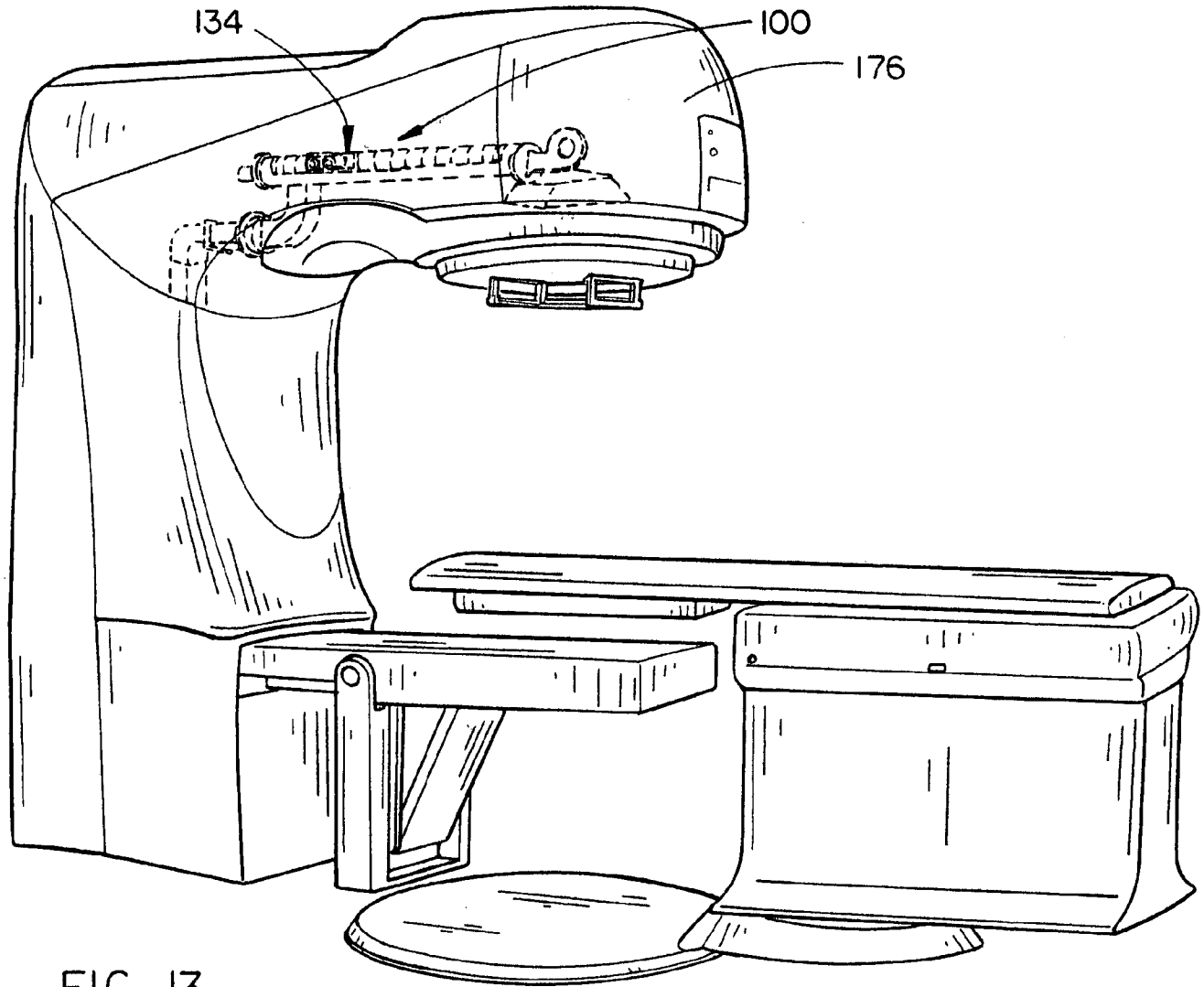
FIG. 13 is an isometric view of the device for external beam radiation treatment illustrated in FIG. 12.

Referring now to FIGS. 12 and 13, the linear accelerator 100 including the energy switch assembly 134 is included with a radiation treatment device 176, such as a device utilized in radiation oncology, or the like. It will be appreciated that the linear accelerator 100 including the energy switch assembly 134 may be included with other devices for supplying a particle beam at high and low energy levels as well.

Figure 14:
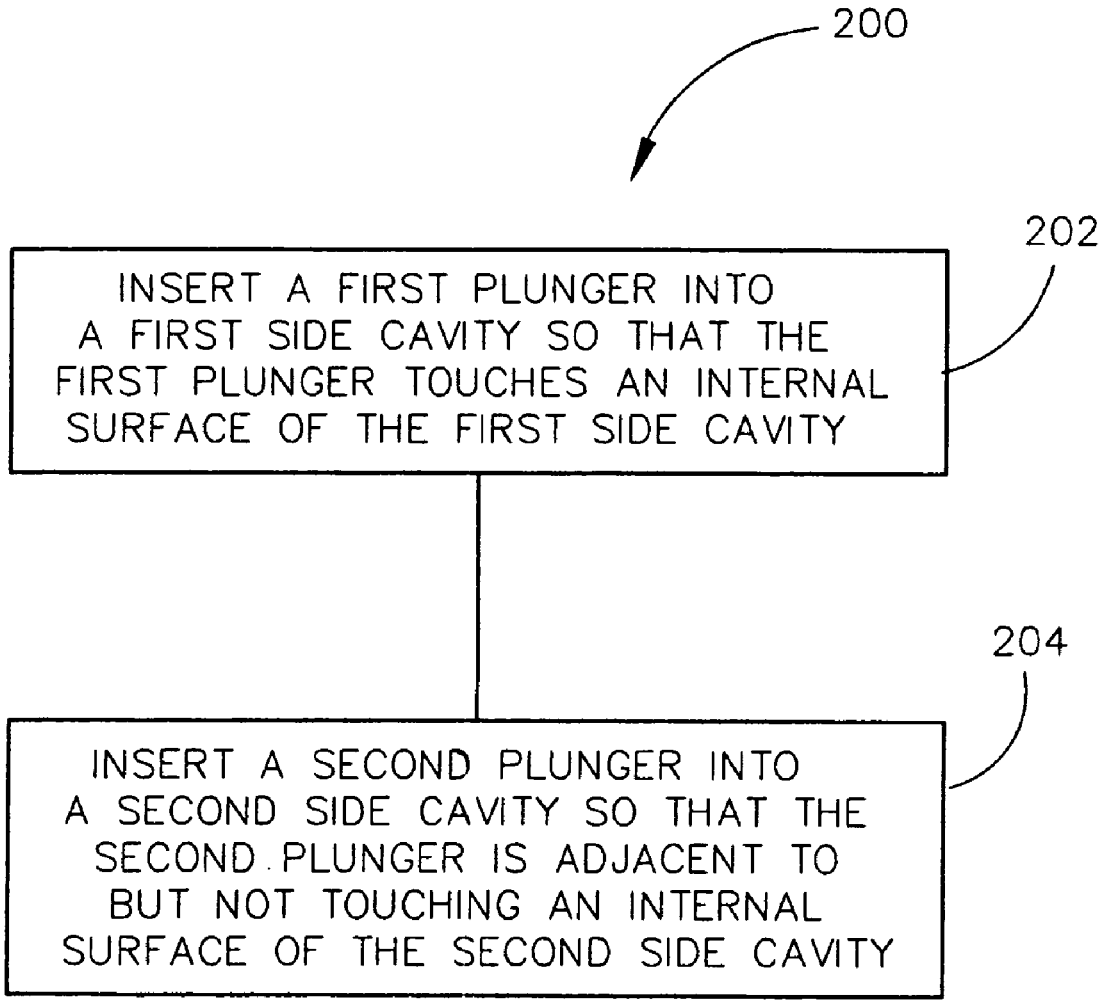
FIG. 14 is a flow diagram illustrating a method for varying the output of a standing wave linear particle beam accelerator in accordance with an exemplary embodiment of the present invention.

Referring to FIG. 14, a method 200 for varying the output of a standing wave linear particle beam accelerator is described in accordance with exemplary embodiments of the present invention. In embodiments, the linear particle beam accelerator has a plurality of accelerating cavities and a plurality of side cavities, each side cavity electromagnetically coupling adjacent accelerating cavities. First, a first plunger is radially inserted into a first side cavity for detuning the first side cavity and decreasing the electric field amplitude in accelerating cavities following the first side cavity. For example, in one specific embodiment, a first plunger is inserted into a first side cavity so that the first plunger touches an internal surface of the first side cavity opposite the first plunger assembly, 202. The first side cavity electromagnetically couples a first accelerating cavity and a second accelerating cavity adjacent to the first accelerating cavity and has at least approximately the same resonant frequency as the first accelerating cavity.

Then, a second plunger is radially inserted into a second side cavity for detuning the second side cavity and increasing the electric field amplitude in accelerating cavities between the first plunger assembly and the second plunger assembly. For instance, in one specific embodiment, a second plunger is inserted into a second side cavity so that the second plunger is adjacent to, but not touching, an internal surface of the second side cavity opposite the second plunger assembly, 204. The second side cavity electromagnetically couples a third accelerating cavity downstream of the second accelerating cavity and a fourth accelerating cavity adjacent to the third accelerating cavity, the fourth accelerating cavity having at least approximately the same resonant frequency as the third accelerating cavity.

In the exemplary embodiments, method 200 may be implemented as sets of instructions or software readable by the radiographic imaging device. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention. The accompanying method claims present elements of the various steps in a sample order, and are not necessarily meant to be limited to the specific order or hierarchy presented.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An energy switch assembly for a standing wave linear particle beam accelerator having a plurality of accelerating cavities and a plurality of side cavities, each side cavity electromagnetically coupling adjacent ones of the accelerating cavities, the energy switch assembly comprising:

a first plunger assembly having a first plunger positionable within a first side cavity; and a second plunger assembly having a second plunger positionable within a second side cavity, wherein the first plunger and the second plunger move between a first position where the first plunger is retracted from the first side cavity and the second plunger is retracted from the second side cavity and a second position where the first plunger extends into the first side cavity so that the first plunger touches an internal surface of the first side cavity opposite the first plunger assembly and the second plunger extends into the second side cavity so that the second plunger is adjacent to, but not touching, an internal surface of the second side cavity opposite the second plunger assembly for varying the output of the linear particle beam accelerator.

2. The energy switch assembly as claimed in claim 1, further comprising an actuator assembly mechanically coupled to the first plunger assembly and the second plunger assembly for positioning the first plunger within the first side cavity and the second plunger within the second side cavity, wherein the actuator assembly moves the first plunger and the second plunger between the first position and the second position.

3. The energy switch assembly as claimed in claim 2, wherein the actuator assembly comprises:

an actuator positioned between the first plunger assembly and the second plunger assembly;

a cross bar pivotally connected to the actuator, the first plunger assembly and the second plunger assembly for moving the first plunger and the second plunger between the first position and the second position; and a first thrust bar coupled to the first plunger assembly and a second thrust bar coupled to the second plunger assembly, the first thrust bar and the second thrust bar being engaged by the cross bar for moving the first plunger and the second plunger, wherein the actuator assembly provides synchronous actuation of the first plunger and the second plunger.

4. The energy switch assembly as claimed in claim 1, further comprising at least one clamp plate for coupling the first plunger assembly to the first side cavity and the second plunger assembly to the second side cavity.

5. The energy switch assembly as claimed in claim 4, wherein the standing wave linear particle beam accelerator comprises:

a first accelerating cavity;

a second accelerating cavity adjacent to the first accelerating cavity, the second accelerating cavity having at least approximately the same resonant frequency as the first accelerating cavity;

a third accelerating cavity downstream of the second accelerating cavity, the third accelerating cavity having at least approximately the same resonant frequency as the second accelerating cavity; and a fourth accelerating cavity adjacent to and downstream of the third accelerating cavity, the fourth accelerating cavity having at least approximately the same resonant frequency as the third accelerating cavity, wherein the first side cavity electromagnetically couples the first accelerating cavity and the second accelerating cavity and the second side cavity electromagnetically couples the third accelerating cavity and the fourth accelerating cavity and the clamp plate attaches the first plunger assembly to the first side cavity and the second plunger assembly to the second side cavity.

6. The energy switch assembly as claimed in claim 1, further comprising a microswitch assembly for detecting when the first plunger and the second plunger are in the first position and the second position.

7. The energy switch assembly as claimed in claim 1, wherein the energy switch assembly is air cooled.

8. A standing wave linear particle beam accelerator, comprising:

a first accelerating cavity;

a second accelerating cavity adjacent to the first accelerating cavity, the second accelerating cavity having at least approximately the same resonant frequency as the first accelerating cavity;

a first side cavity electromagnetically coupling the first accelerating cavity and the second accelerating cavity;

a third accelerating cavity downstream of the second accelerating cavity, the third accelerating cavity having at least approximately the same resonant frequency as the second accelerating cavity;

a fourth accelerating cavity adjacent to and downstream of the third accelerating cavity, the fourth accelerating cavity having at least approximately the same resonant frequency as the third accelerating cavity;

a second side cavity electromagnetically coupling the third accelerating cavity and the fourth accelerating cavity;

a first plunger assembly having a first plunger positionable within the first side cavity; and a second plunger assembly having a second plunger positionable within the second side cavity, wherein the first plunger and the second plunger move between a first position where the first plunger is retracted from the first side cavity and the second plunger is retracted from the second side cavity and a second position where the first plunger extends into the first side cavity so that the first plunger touches an internal surface of the first side cavity opposite the first plunger assembly and the second plunger extends into the second side cavity so that the second plunger is adjacent to, but not touching, an internal surface of the second side cavity opposite the second plunger assembly for varying the output of the linear particle beam accelerator.

9. The standing wave linear particle beam accelerator as claimed in claim 8, further comprising an actuator assembly mechanically coupled to the first plunger assembly and the second plunger assembly for positioning the first plunger within the first side cavity and the second plunger within the second side cavity, wherein the actuator assembly moves the first plunger and the second plunger between the first position and the second position.

10. The standing wave linear particle beam accelerator as claimed in claim 9, wherein the actuator assembly comprises:

an actuator positioned between the first plunger assembly and the second plunger assembly;

a cross bar pivotally connected to the actuator, the first plunger assembly and the second plunger assembly for moving the first plunger and the second plunger between the first position and the second position; and a first thrust bar coupled to the first plunger assembly and a second thrust bar coupled to the second plunger assembly, the first thrust bar and the second thrust bar being engaged by the cross bar for moving the first plunger and the second plunger, wherein the actuator assembly provides synchronous actuation of the first plunger and the second plunger.

11. The standing wave linear particle beam accelerator as claimed in claim 8, further comprising at least one clamp plate for coupling the first plunger assembly to the first side cavity and the second plunger assembly to the second side cavity.

12. The standing wave linear particle beam accelerator as claimed in claim 8, further comprising a microswitch assembly for detecting when the first plunger and the second plunger are in the first position and the second position.

13. The standing wave linear particle beam accelerator as claimed in claim 8, wherein the first plunger assembly and the second plunger assembly are air cooled.

14. A radiation treatment device, comprising:

a standing wave linear particle beam accelerator having a plurality of accelerating cavities and a plurality of side cavities, each side cavity electromagnetically coupling adjacent ones of the accelerating cavities; and an energy switch assembly including a first plunger assembly having a first plunger positionable within a first side cavity, a second plunger assembly having a second plunger positionable within a second side cavity, and an actuator assembly mechanically coupled to the first plunger assembly and the second plunger assembly for moving the first plunger and the second plunger between a first position where the first plunger is retracted from the first side cavity and the second plunger is retracted from the second side cavity and a second position where the first plunger extends into the first side cavity so that the first plunger touches an internal surface of the first side cavity opposite the first plunger assembly and the second plunger extends into the second side cavity so that the second plunger is adjacent to but not touching an internal surface of the second side cavity opposite the second plunger assembly, wherein the first plunger and the second plunger are moved between the first position and the second position for varying the output of the linear particle beam accelerator.

15. The radiation treatment device as claimed in claim 14, wherein the actuator assembly comprises:

an actuator positioned between the first plunger assembly and the second plunger assembly;

a cross bar pivotally connected to the actuator, the first plunger assembly and the second plunger assembly for moving the first plunger and the second plunger between the first position and the second position; and a first thrust bar coupled to the first plunger assembly and a second thrust bar coupled to the second plunger assembly, the first thrust bar and the second thrust bar being engaged by the cross bar for moving the first plunger and the second plunger, wherein the actuator assembly provides synchronous actuation of the first plunger and the second plunger.

16. The radiation treatment device as claimed in claim 14, wherein the energy switch assembly further comprises a clamp plate for coupling the first plunger assembly to the first side cavity and the second plunger assembly to the second side cavity.

17. The radiation treatment device as claimed in claim 14, wherein the energy switch assembly further comprises a microswitch assembly for detecting when the first plunger and the second plunger are in the first position and the second position.

18. The radiation treatment device as claimed in claim 14, wherein the energy switch assembly is air cooled.

19. A method for varying the output of a standing wave linear particle beam accelerator having a plurality of accelerating cavities and a plurality of side cavities, each side cavity electromagnetically coupling adjacent ones of the accelerating cavities, comprising:

inserting a first plunger into a first side cavity so that the first plunger touches an internal surface of the first side cavity opposite the first plunger assembly, the first side cavity electromagnetically coupling a first accelerating cavity and a second accelerating cavity adjacent to the first accelerating cavity and having at least approximately the same resonant frequency as the first accelerating cavity; and inserting a second plunger into a second side cavity so that the second plunger is adjacent to, but not touching, an internal surface of the second side cavity opposite the second plunger assembly electromagnetically coupling a third accelerating cavity downstream of the second accelerating cavity and a fourth accelerating cavity adjacent to the third accelerating cavity, the fourth accelerating cavity having at least approximately the same resonant frequency as the third accelerating cavity.

20. The method as claimed in claim 19, wherein the first plunger and the second plunger are inserted into the first side cavity and the second side cavity simultaneously by an actuator assembly.

* * * * *